US005690310A

United States Patent [19]

Brown

[11] Patent Number: 5,690,310

[45] Date of Patent: Nov. 25, 1997

[54] ADJUSTABLE BOOK STAND

[76] Inventor: Dwayne Brown, 3408 S. 81st Ave., Omaha, Nebr. 68124

[21] Appl. No.: 738,484

[22] Filed: Oct. 28, 1996

Related U.S. Application Data

[63] Continuation-in-part of Ser. No. 496,379, Jun. 29, 1995, abandoned.

[51] Int. Cl.[6] ..... A47B 97/04

[52] U.S. Cl. ..... 248/448; 248/449; 248/444.1

[58] Field of Search ..... 248/444.1, 445, 248/446, 447, 449, 371, 448

[56] References Cited

U.S. PATENT DOCUMENTS

| | | | |
|---|---|---|---|
| 551,256 | 12/1895 | Brown . | |
| 756,631 | 4/1904 | Herbert | 248/448 |
| 809,310 | 1/1906 | Long . | |
| 1,483,421 | 2/1924 | Farnham | 248/453 |
| 1,601,463 | 9/1926 | White et al. . | |
| 1,790,487 | 1/1931 | Ruhnau . | |
| 2,134,810 | 11/1938 | Boyle | 248/449 |
| 3,193,240 | 7/1965 | Browett | 248/449 |
| 3,366,359 | 1/1968 | Wolf et al. | 248/447 |
| 4,123,029 | 10/1978 | Gillotti | 248/453 |
| 4,165,856 | 8/1979 | Wiseheart | 248/458 X |
| 4,475,705 | 10/1984 | Henneberg et al. | 248/451 |
| 5,356,109 | 10/1994 | Biasini | 248/448 |
| 5,375,806 | 12/1994 | Debus et al. | 248/444.1 |

FOREIGN PATENT DOCUMENTS

| | | | |
|---|---|---|---|
| 208814 | 4/1960 | Germany | 248/451 |
| 1031812 | 6/1966 | United Kingdom | 248/451 |
| 2223672 | 4/1990 | United Kingdom | 248/451 |

*Primary Examiner*—Ramon O. Ramirez
*Assistant Examiner*—Willie Berry, Jr.
*Attorney, Agent, or Firm*—Henderson & Sturm

[57] ABSTRACT

A book stand that is adjustable in the vertical as well as in tilt, and which utilizes a book ledge which is adjustable in width so as to accommodate books and other reading materials of different thicknesses. The backplate of the book holder has a rear book ledge secured along its lower edge, with a plurality of apertures extending therethrough. These apertures receive a plurality of pegs or rods extending from a front book ledge. The pegs may be positioned at varying distances within the apertures and thereby position the front ledge with respect to the rear ledge so as to accommodate books are varying thicknesses. The front ledge has a transparent page-holder extending perpendicular to its upper surface to hold back the pages of the printed material. The invention also includes an extension plate which rests on the two ledges for ring binders which may be quite thick but do not require the page-holder.

2 Claims, 5 Drawing Sheets

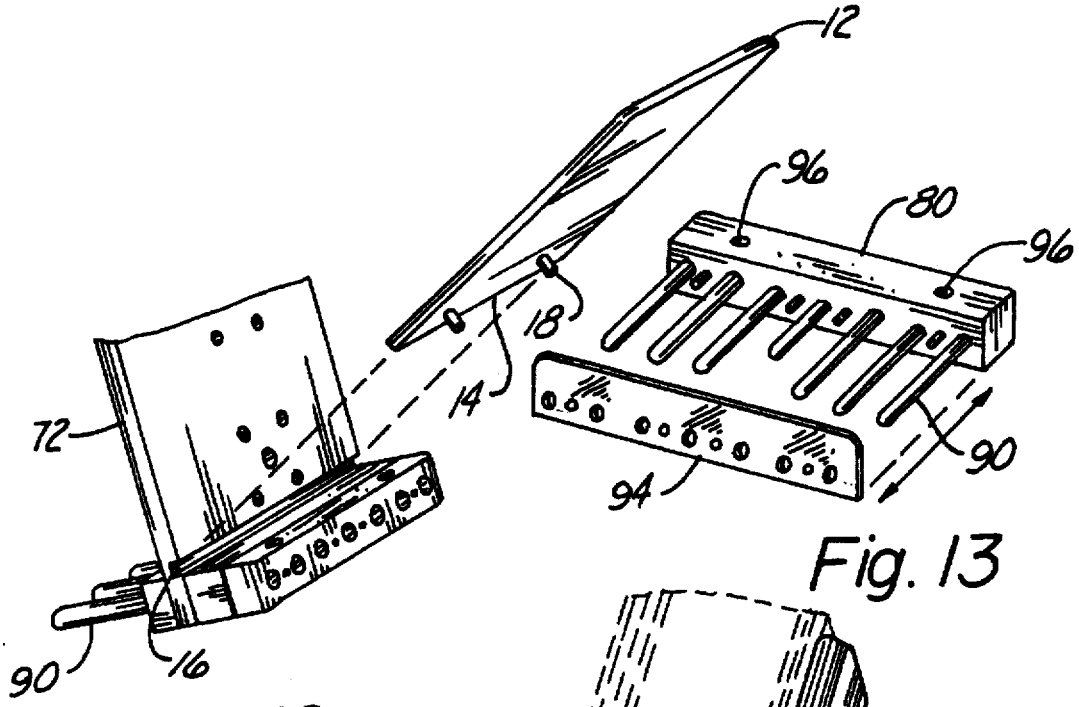
Fig. 13
Fig. 10
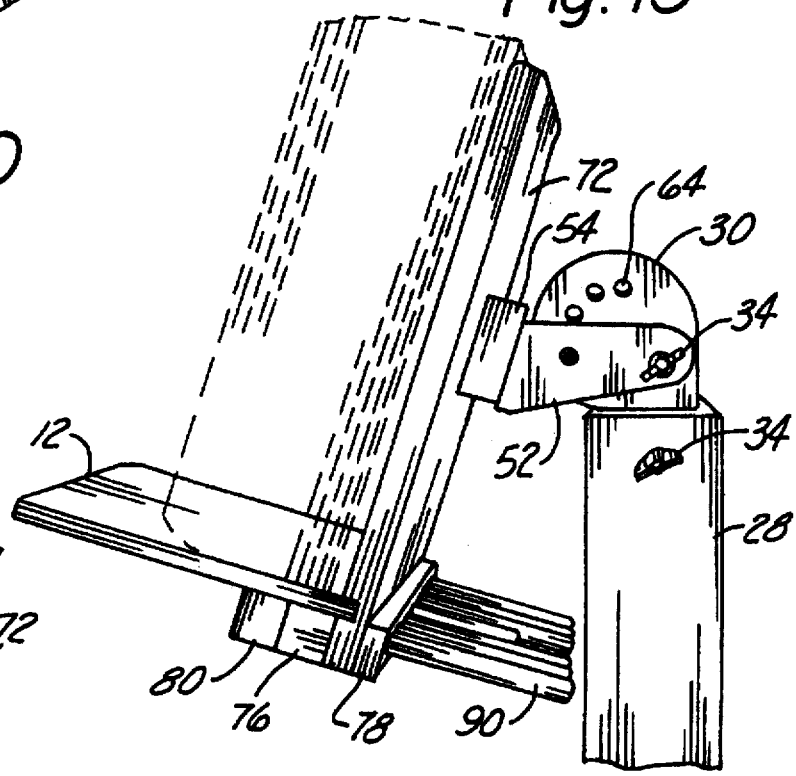
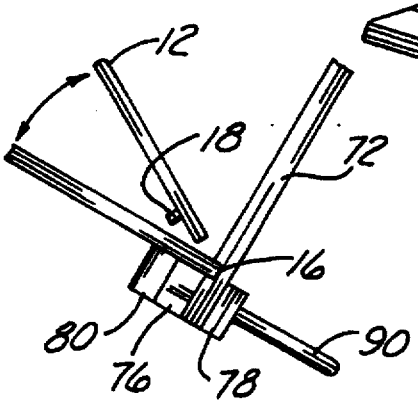
Fig. 11
Fig. 12

ADJUSTABLE BOOK STAND

CROSS-REFERENCE TO RELATED APPLICATIONS

This application is a Continuation-in-Part of application Ser. No. 08/496,379, filed Jun. 29, 1995, now abandoned, the disclosure of which is incorporated by reference herein in its entirety.

STATEMENT REGARDING FEDERALLY SPONSORED RESEARCH OR DEVELOPMENT

Not Applicable.

BACKGROUND OF THE INVENTION

1. Field of the Invention

The present invention relates to devices for holding books in an open, readable position so the reader may have his hands free for other work.

2. Description of the Related Art

A useful stand for books, sheet music, and other reading material must satisfy two basic requirements. First, it must be capable of positioning the material so that it may be readily viewed by the reader. Second, it must be capable of holding the material, especially books, open with the pages held back.

Adjustable stands are well known in the art and while these devices are quite satisfactory inasmuch as their directional adjustability is concerned, in that they may be moved in the vertical and may be tilted so as to face the viewer, they are not satisfactory for the numerous types of books and other documents of varying thicknesses that must be placed upon them.

BRIEF SUMMARY OF THE INVENTION

The present invention discloses a book stand that is adjustable in the vertical as well as in tilt, and which utilizes a book ledge which is adjustable in width so as to accommodate books and other reading materials of different thicknesses. The backplate of the book holder has a rear book ledge secured along its lower edge, with a plurality of apertures extending therethrough. These apertures receive a plurality of pegs or rods extending from a front book ledge. The pegs may be positioned at varying distances within the apertures and thereby position the front ledge with respect to the rear ledge so as to accommodate books are varying thicknesses. The front ledge has a transparent page-holder extending perpendicular to its upper surface to hold back the pages of the printed material. The invention also includes an extension plate which rests on the two ledges for ring binders which may be quite thick but do not require the page-holder.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein:

FIG. 10 is a perspective view showing the attachment of the extension plate;

FIG. 11 depicts the extension plate in place on the book ledge, with a very thick book shown in phantom lines;

FIG. 12 is a side view showing the insertion of the extension plate; and

FIG. 13 depicts the removal of the page keeper from the front ledge.

DETAILED DESCRIPTION OF THE INVENTION

Figure 1:
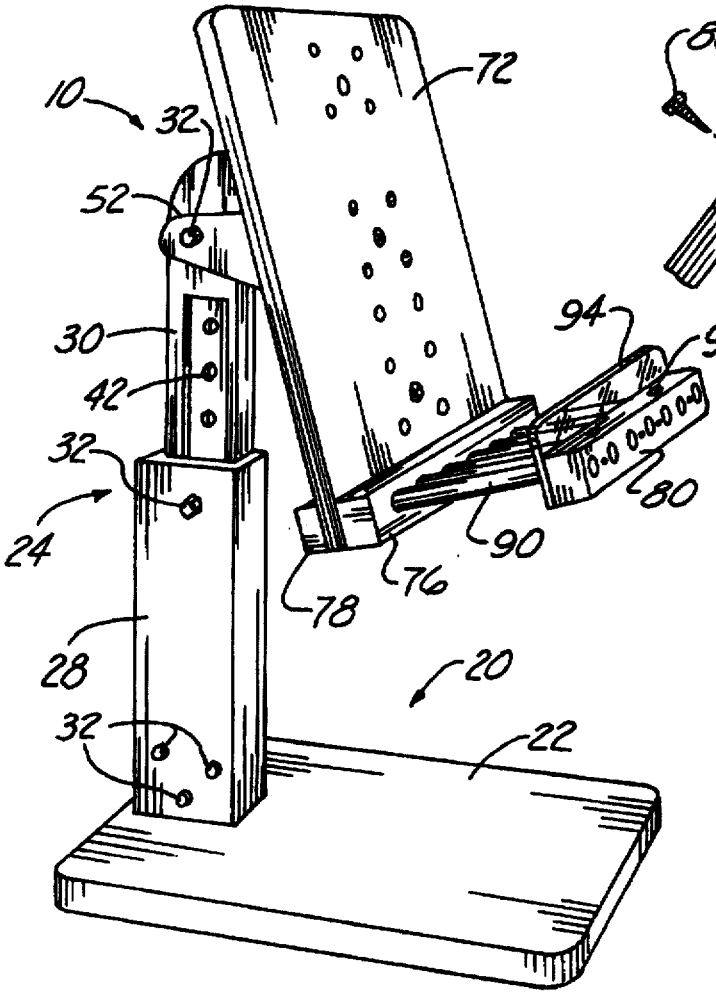
FIG. 1 is a front perspective view of the invention.

Referring now to the drawings, wherein like reference numerals designate identical or corresponding parts throughout the several views, the invention is depicted at 10 in FIG. 1 and can be seen to comprise a base 20 having a baseplate 22 and an adjustable vertical support tower 24, and a book holder 70 having a backplate 72 and an adjustable width book ledge 74. Although the preferred embodiment is fabricated from molded plastic components, it should be understood by those familiar with the art that other materials such as wood or various metals would also be appropriate.

Figure 9:
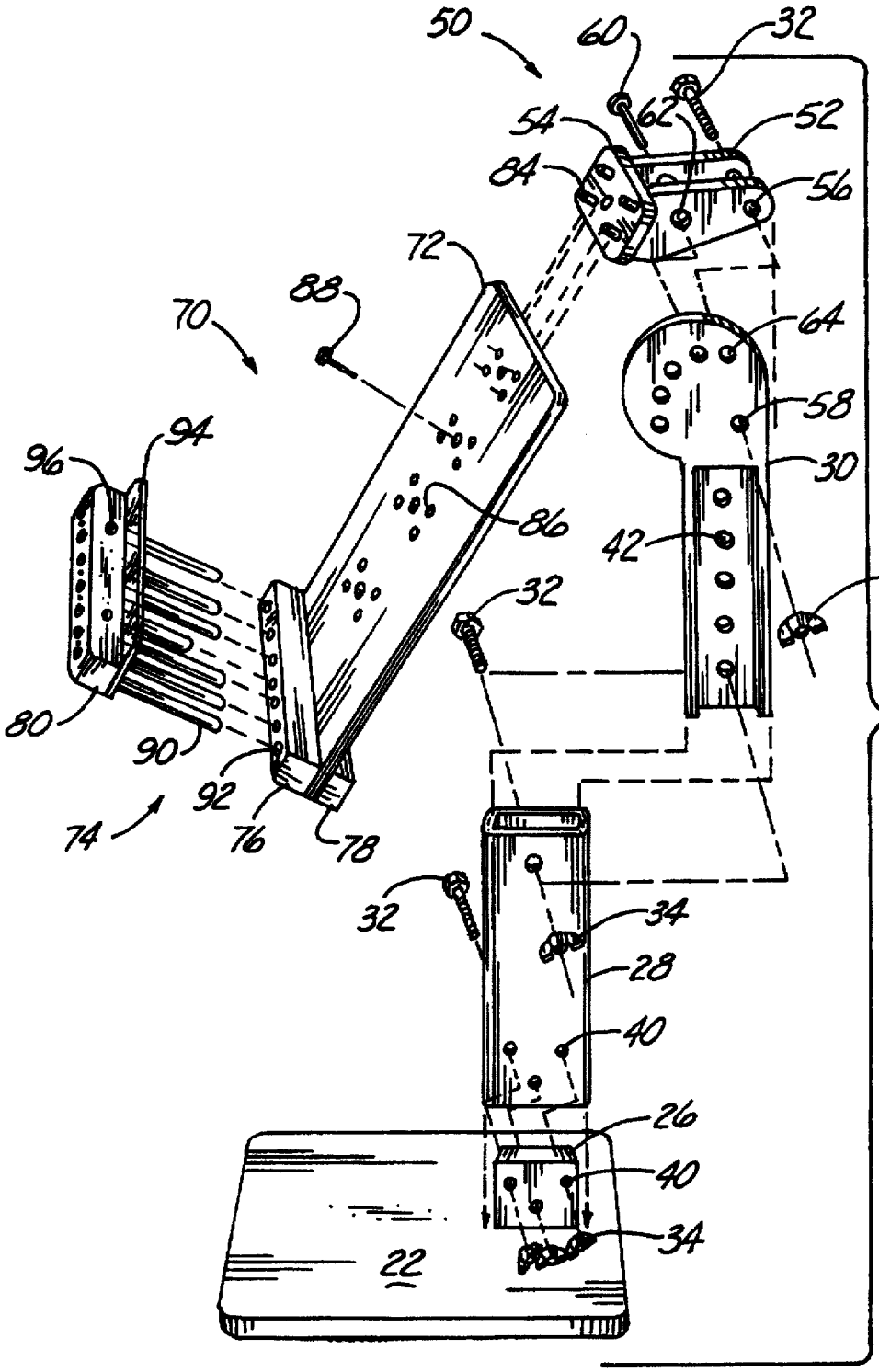
FIG. 9 is an exploded view of the invention.

Referring now primarily to the exploded view of FIG. 9, the vertical support tower 24 is seen to comprise a column support 26, a hollow female column 28, and a male column 30. The column support 26 is secured to the baseplate 22 by a pair of screws (now shown) which extend upward through the bottom of the baseplate 22 and into the column support 26. The rectangular, hollow female column 28 is affixed to the column support 26 by three bolts 32 and wingnuts 34 which extend through aligned holes 40 in both. The male column 30, preferably having an I-beam type construction to save on materials and weight, is telescopically received within the female column 28 and is vertically adjustable by means of a plurality of vertically spaced holes 42 in the male column 30, a hole 44 near the top of the female column 28, and a bolt 32 and wingnut 34. The upper portion of the male column 30 is flat on opposing sides and rounded with a forward extension to receive the spaced flanges 52 of the pivot unit 50. The two flanges 52 are secured to the backplate holder 54 by means of four screws (not shown) which extend through the backplate holder 54 and into the flanges 52. The two flanges 52 have pivot holes 56 which align with a pivot hole 58 in the male column 30 to allow the bookholder 70 to pivot to various angles on a bolt 32 secured by a wingnut 34. The bookholder 70 is fixed at a particular angle by means of a pin 60 which extends through holes 62 in the flanges 5;2 and through one of a series of angle adjustment holes 64 in the top of the male column 30.

Figure 4:
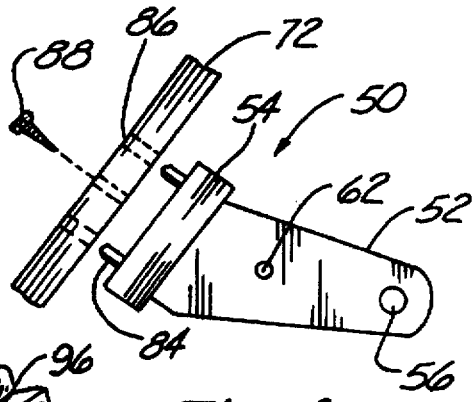
FIG. 4 is a side view depicting the method of attachment of the pivot unit to the backplate.

Referring also to FIG. 4, the backplate holder 50 is affixed to one of four selectable locations on the rear of the back plate 72 to provide additional vertical positions for a book. The backplate holder 50 has four shod pins 84 protruding from its face which mate with holes 86 in the back plate 72. A screw 88 then secures the backplate holder 54 to the backplate 72.

Figure 3:
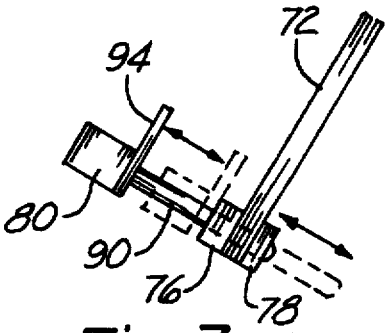
FIG. 3 is a side view of the adjustable book ledge of the invention, and depicts the book ledge in the extended position in solid lines and in the closed position in phantom lines.
Figure 2:
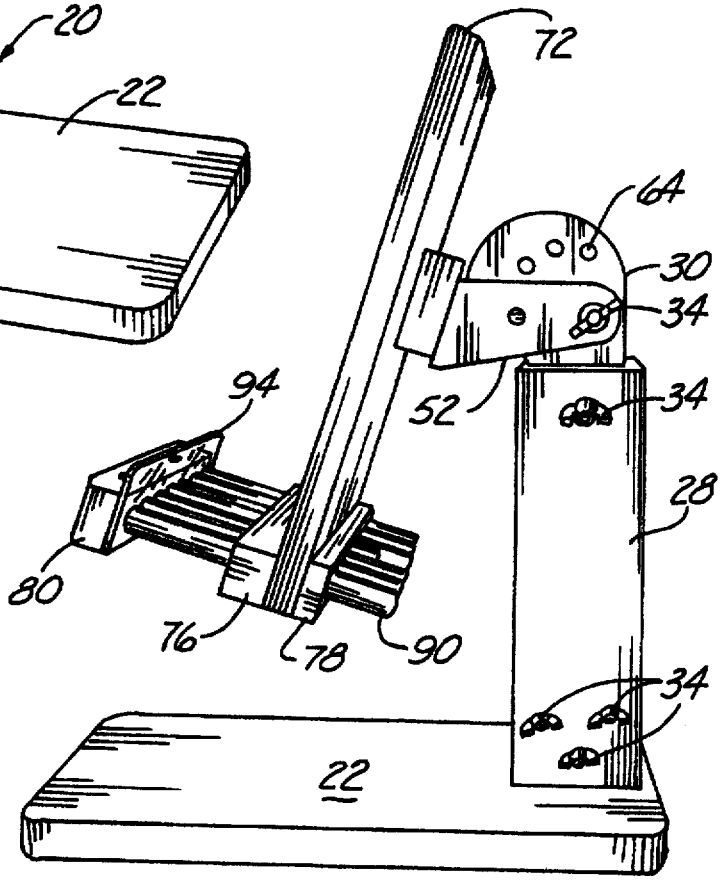
FIG. 2 is a side view of the invention with the book holder in the lowered position and the book ledge in an extended position.
Figure 5:
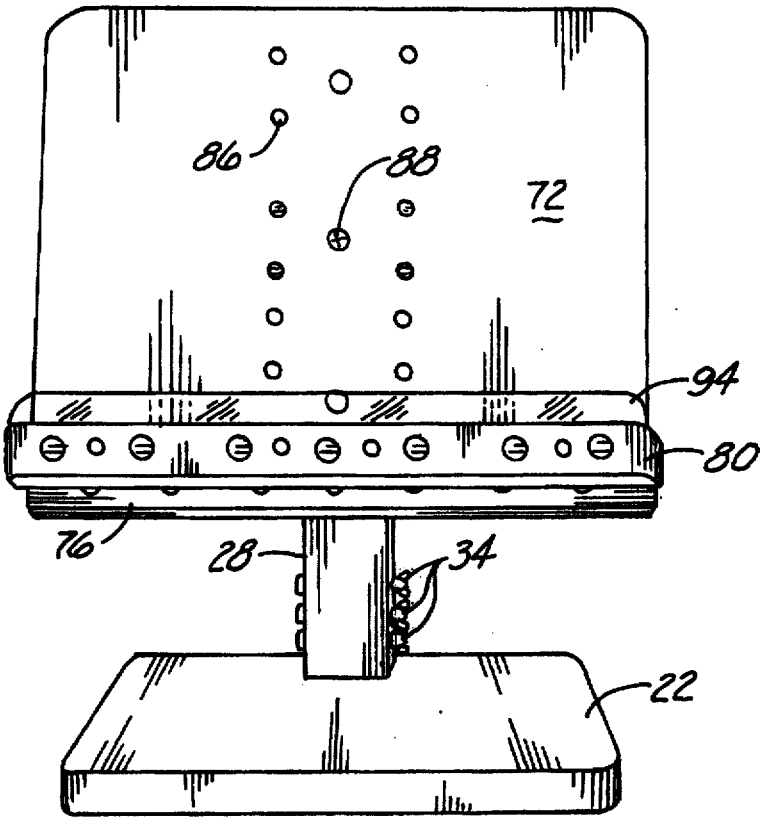
FIG. 5 is front view of the invention.
Figure 6:
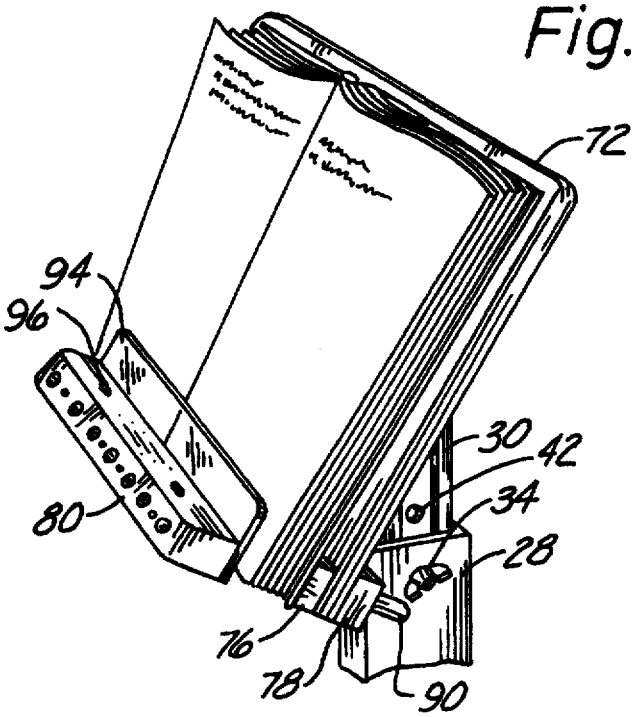
FIG. 6 is a perspective view of the book holder of the invention with a book mounted thereon.
Figure 7:
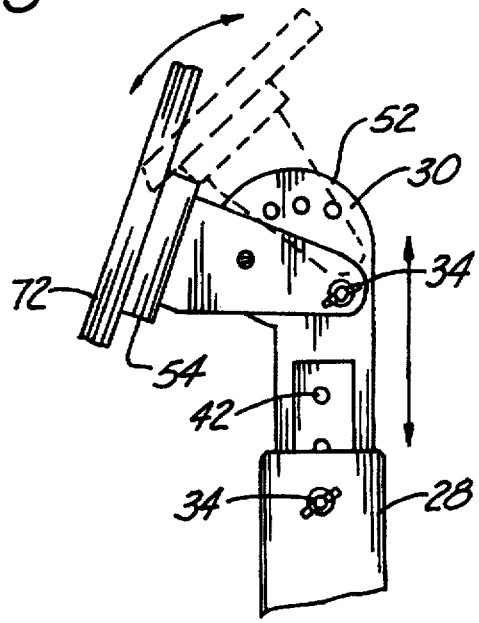
FIG. 7 is a partial side view showing the vertical and tilt adjustment mechanisms of the invention.
Figure 8:
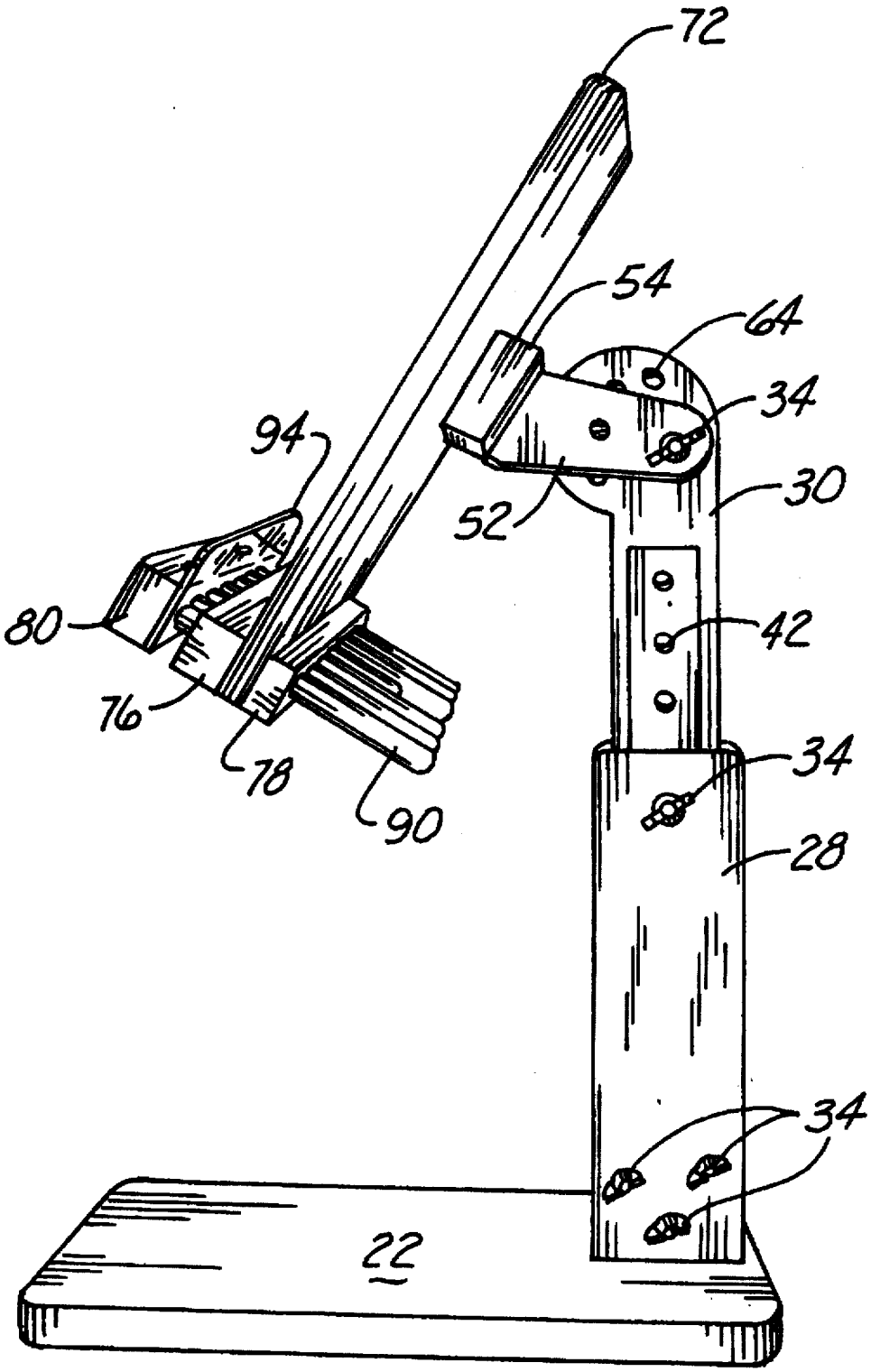
FIG. 8 is a side view of the invention with the book holder in a raised position and the book ledge in a nearly closed position.

The book ledge 74 is comprised of a rear ledge 76 and reinforcement strip 78 affixed along the lower edge of backplate 72, and a front ledge 80 having seven pegs 90 extending rearwardly therefrom. The pegs 90 slidably extend within seven holes 92 formed in the rear ledge 76, lower edge of backpiece 62, and reinforcement strip 78, thereby allowing the width of the book ledge 74 to be adjusted to accommodate books of various thicknesses. (See also FIG. 3) The front ledge 80 also utilizes a perpendicular, transparent page-keeper 94 to hold the book placed thereon in an open position. (See also FIG. 6). The page-keeper 94 has a seven holes along its lower edge and slides onto the pegs 90 of the front ledge 80.

Referring now to FIGS. 10–13, an extension plate 12 is shown for use with ring-binders and other very thick publications. The page-keeper 94 must first be removed from the pegs 90 as seen in FIG. 13, and then the book ledge 74 is moved to its closed position. The edge 14 of the extension plate 12 is then inserted into the groove 16 extending across the lower edge of the backplate 72 just above the rear ledge 76. A pair of pins 18 extending from the lower surface of the extension plate 12 are then inserted into a pair of holes 96 in the front ledge 80 to hold the extension plate 12 in place.

While the invention has been described with a certain degree of particularity, it is manifest that many changes may be made in the details of construction and the arrangement of the components without departing from the spirit and scope of the disclosure. It is therefore to be understood that the invention is not limited to the embodiment set forth herein for purposes of exemplification, but is to be limited only by the scope of the appended claims, including the full range of equivalency to which each element thereof is entitled.

What is claimed is:

1. An adjustable book stand, comprising:

(a) a base having a horizontal baseplate with a vertical support tower extending therefrom;

(b) a book holder, pivotally attached to said vertical support tower, having a backpiece and an adjustable width ledge; said adjustable width ledge including a rear ledge secured to the lower edge of said backpiece and having a plurality of apertures formed therethrough, and a front ledge having a plurality of pegs extending therefrom, said pegs slidably positioned within said apertures of said rear ledge whereby said front ledge may be positioned at variable distances from said rear ledge; said front ledge further including a transparent pagekeeper having a plurality of apertures removably secured upon said pegs for engagement with pages of a book placed upon said ledge.

2. The adjustable book stand of claim 1 and further comprising an extension plate removably secured upon said adjustable width ledge for supporting a ring binder and the like.

* * * * *